United States Patent [19]

Williams

[11] 4,345,539

[45] Aug. 24, 1982

[54] WARNING SYSTEM WITH PNEUMATIC FUNCTION GENERATOR

[75] Inventor: Henry L. Williams, Oklahoma City, Okla.

[73] Assignee: Geosource Inc., Houston, Tex.

[21] Appl. No.: 141,770

[22] Filed: Apr. 21, 1980

[51] Int. Cl.[3] ..... B66B 3/02

[52] U.S. Cl. ..... 116/68; 137/82; 137/551; 212/153; 116/67 R

[58] Field of Search ..... 116/68, 67 R; 137/551, 137/82, 85; 91/189 R, 189 A; 340/685; 212/153, 154, 155, 149, 150, 151, 152; 200/235 R

[56] References Cited

U.S. PATENT DOCUMENTS

| | | | |
|---|---|---|---|
| 2,222,551 | 11/1940 | Ziebolz . | |
| 2,967,537 | 1/1961 | Morris | 137/82 |
| 3,018,041 | 1/1962 | Bidwell . | |
| 3,239,140 | 3/1966 | Armstrong . | |
| 3,254,837 | 6/1966 | Falconer . | |
| 3,278,925 | 10/1966 | Saunder | 73/133 R |
| 3,491,229 | 1/1970 | Mityashin . | |

FOREIGN PATENT DOCUMENTS

| | | | |
|---|---|---|---|
| 632356 | 7/1936 | Fed. Rep. of Germany | 91/189 |

OTHER PUBLICATIONS

Load and Radius Indicating Systems, Brochure on "Sheave Master", issued Jan. 1975.

*Primary Examiner*—Kyle L. Howell
*Assistant Examiner*—Denis E. Corr
*Attorney, Agent, or Firm*—Arnold, White & Durkee

[57] ABSTRACT

A totally pneumatic crane warning system is disclosed capable of use in oil well environments. The crane warning system utilizes a pneumatic function generator. The pneumatic function generator includes a means for receiving a linear pneumatic signal that may be representative of a boom angle and translating that signal to a non-linear output representative of the maximum load capacity of the crane at that angle. This function is accomplished through the use of a rolling cam machined to represent the functional relationship between the boom angle and the maximum load capacity at that angle. This relationship has been found to be non-linear in nature. A pneumatic control circuit is utilized in conjunction with the rolling cam to effect the pneumatic output signal that is representative of the maximum load capacity at a given boom angle. The crane warning system is further provided with a means for comparing the maximum load signal with the actual load of the crane and actuating a pneumatic warning device when the actual weight exceeds the maximum load capacity output of the function generator.

12 Claims, 4 Drawing Figures

WARNING SYSTEM WITH PNEUMATIC FUNCTION GENERATOR

BACKGROUND OF THE INVENTION

The invention is generally directed toward a crane warning system and more particularly directed toward a crane warning system utilizing a pneumatic function generator.

Users of crane and other boom-type load lifting devices continually fight hazardous working conditions with respect to overloading. The criteria used in determining overloading include a computed load capacity based upon the type of crane, the length of the boom, and the boom angle. At any given boom angle and boom length there is a computed load capacity for the crane. This is the maximum loading in order to have safe working conditions. In many instances the operator is called upon to determine safe conditions based on his experience and boom angle and length.

Several efforts have been made in the art to automatically indicate a safe or hazardous condition regarding weight on boom-type lifting devices. One such system is manufactured by Dillon Corporation under the name Cranegard, the Cranegard system is an electronic system using load indicators to measure and display the crane's hookload as a percentage of a preset load limit. The limit is selected by the operator and is determined by the type of crane, boom length, indicated boom angle, and other operating conditions. Internal system relays will activate an audible alarm when that limit is exceeded.

A second crane monitoring system is marketed by Tood Research & Technical Division located in Galveston, Tex. under the name TRT Crane Monitor System. This system is also electronic in nature with the signal from a load cell conditioned electronically and displayed on an appropriate load meter.

The Sheave Master System 20 manufactured by Sheave Master Inc., Addison, Tex.; and, the SEQ crane overload warning system manufactured by SEQ Systems, Laporte, Texas, are further examples of load indicating systems for crane and other load lifting devices. The Sheave system utilizes a boom angle sensor and load sensors for delivering electronic signals to a logic module for purposes of calculating hazardous loading conditions. The SEQ crane overload warning system is a solid state electronic device operating on a load moment theory. This system also includes a display module, electronic module, a boom angle sensor, load sensor and interconnect cables.

In all of these systems the operator will set the maximum load limit based on his experience, and knowledge of the boom angle. This limit will be set based upon a loading chart showing boom angle as a function load along with knowledge of the operator regarding his crane system. None of these devices indicates the use of any instrumentation that will automatically calculate the maximum load setting based upon a boom angle sensor signal. Further, a major disadvantage of these systems is in their electronic characteristic. For oil well uses, especially on offshore rigs, any warning system must be explosion proof. Use of electronic systems and the need to make them explosion proof significantly increases cost.

It is further recognized that the functional relationship between the boom angle and the load is a non-linear relationship. In view of the need for an explosion proof system and thus a desireability to have the entire crane warning system to be pneumatic and yet fully automatic, the use of a function generator to translate the linear boom angle signal to the non-linear load signal is advantageous. There are no known pneumatic function generators in the art capable of translating a linear to non-linear signal.

SUMMARY OF THE INVENTION

In accordance with the principles of the present invention a crane warning system is provided. The crane warning is completely pneumatic in nature and is characterized by a pneumatic function generator.

The crane warning system includes a device for sensing boom angle and transmitting a pneumatic signal representative of the boom angle. The system further includes a load cell and means for delivering a pneumatic signal representative of the load cell signal output. The load cell is indicative of the actual weight placed on the boom at any point in time. The actual weight signal is compared to the output of a pneumatic function generator which calculates the maximum weight capability of the boom at a specific boom angle.

The pneumatic function generator includes an air cylinder for receiving the linear boom angle signal. This air cylinder is mechanically connected to a rolling cam machined with a non-linear curve representative of the boom angle and crane load relationship. A bell crank is mechanically and operatively associated with the rolling cam for translating the curve on the rolling cam to a pneumatic output signal. This translation is effected through the use of a second air cylinder performing the function of a slave cylinder with a sensor for relieving pressure in the second air cylinder so as to have it vary in accordance with the movement of the bell crank; thus, achieving a specific output signal based on the non-linear curve.

The output of the pneumatic generator and the pneumatic signal delivered from the load cell, representing actual weight on the boom, are delivered to a differential pressure switch for comparison. If the actual weight from the load cell exceeds the maximum weight designated by the pneumatic function generator a pneumatic warning signal is sent to a pneumatic horn to alarm the operator of the hazardous conditions.

The boom length is a further parameter to be considered in computing the maximum capacity load on the boom, at a given boom angle. A biasing air regulator may be pneumatically connected to increase or decrease the boom angle signal as a function of the boom length.

The pneumatic warning signal may further include pneumatic gauges for giving the operator a constant visual reading of the boom angle and the actual boom weight versus the maximum capacity weight. These guages are connected to the appropriate pneumatic devices responsible for delivering signals indicative of the maximum capacity, actual weight and boom angle.

BRIEF DESCRIPTION OF THE DRAWINGS

For a more complete understanding of the invention reference is made to the drawings where like parts are labeled with the same reference numerals and having the following description.

DETAILED DESCRIPTION OF THE INVENTION

Figure 1:
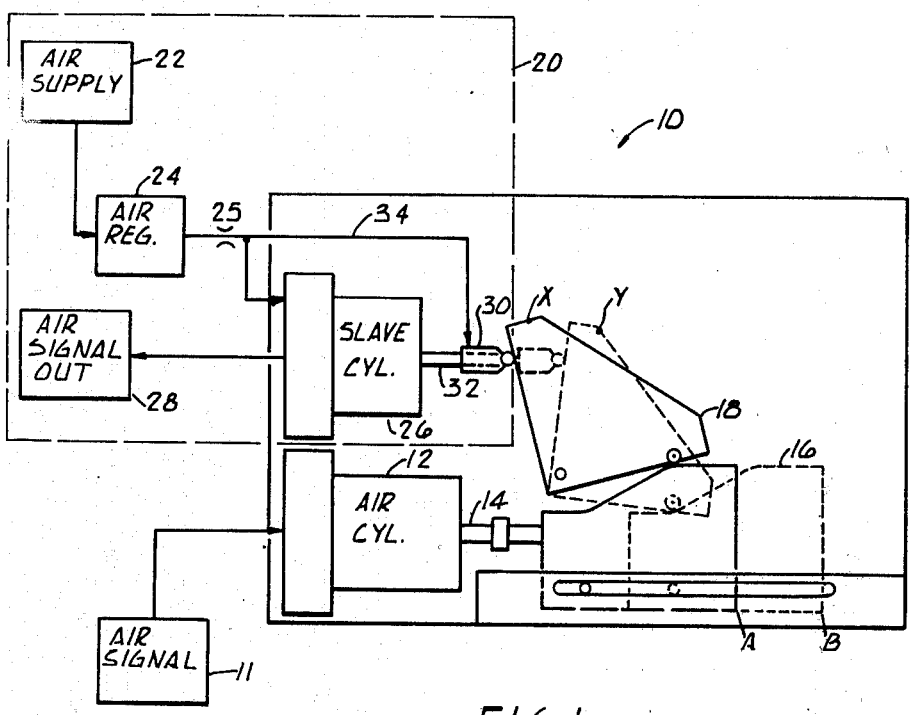
FIG. 1 is a top diagrammatic view of the pneumatic generator utilized in the pneumatic crane warning system in accordance with the principles of the present invention.

Referring now to FIG. 1 a pneumatic function generator 10 is illustrated. This pneumatic function generator may be used in a crane warning system such as the crane warning system illustrated and described hereinbelow with regard to FIG. 4.

The pneumatic function generator 10 includes a means for receiving an input air signal 11, this means may be in the form of an air cylinder 12. The air cylinder 12 besides having the ability to receive an input air signal has a further feature of a movable shaft 14 that operates as a linear function of the pressure generated by the input air signal 11.

A rolling cam 16 is provided in the pneumatic function generator 10. This rolling cam 16 is machined to simulate a non-linear function in a mechanical system. The rolling cam 16 is mechanically connected to the air cylinder 12 through mechanical shaft 14. When the input air signal 11 generates enough pressure to move the shaft 14 the rolling cam is also moved from a position A to a position B as shown in FIG. 1.

The pneumatic function generator 10 further includes a means for pneumatically translating the non-linear function represented on the rolling cam into a pneumatic air signal output. The preferred embodiment of accomplishing this function is a bell crank 18. The bell crank is mechanically associated with the rolling cam 16 so as to be movable therewith upon translation of the rolling cam 16 by the shaft 14.

A pneumatic control circuit 20 is cooperatively associated with the bell crank 18 to effect the desired pneumatic signal output. The control circuit 20 includes an air supply 22 feeding an air regulator 24 through an orifice 25 yielding a supply of pressurized air at approximately 20 psi to a slave air cylinder 26 and to a sensor valve 30. The air cylinder 26 has a means for receiving the regulated air signal controlled by a restricted orifice connecting the regulator 24 and the slave cylinder 26. The slave cylinder 26 further has a means for delivering an output air signal 28.

The output air signal 28 is determined by the pressure in the slave air cylinder 26. This pressure is determined by the position of the bell crank 18 moving against the sensor valve 30 connected to the shaft 32 of the slave cylinder 26. The sensor valve 30 is pneumatically connected to modulate pressure from the slave air cylinder 26 through line 34. When the bell crank 18 being positioned by cylinder 12 moves from position X to position Y, the sensor valve 30 will close allowing pressure to build with the shaft in slave cylinder 26 thus positioning shaft 32 and sensor 30 back into contact with bell crank 18 at position Y. In a similar manner, if air cylinder 12 retracts forcing bell crank 18 into contact with sensor valve 30, sensor valve 30 will exhaust pressure in line 34 allowing slave air cylinder 26 to retract thus establishing new position X FIG. 1. It can be readily seen that slave air cylinder 26 will continually follow bell crank 18 which is positioned by air cylinder 12. This change in pressure is delivered as in output signal 28 indicative of the position of the bell crank 18 on the rolling cam 16. The air signal 28 is the non-linear output based upon the curve mechanically represented on the rolling cam 16 which is translated by the linear input air signal 11.

Figure 2:
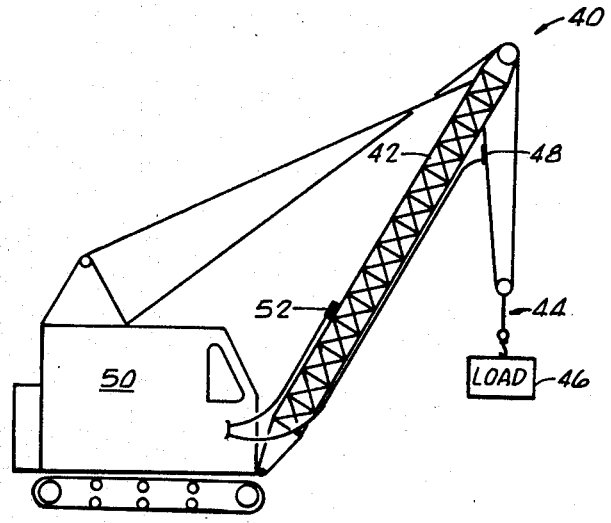
FIG. 2 is a pictorial view of a crane showing a load cell and boom angle transmitter utilized in accordance with the crane warning system of the present invention.

FIG. 2 illustrates a simple crane mechanism 40 having a boom 42 and a pulley and hook assembly 44 for lifting a load 46. The weight of load 46 is sensed in a tension load cell 48 and delivered to a crane warning system illustrated in FIG. 4 and located in the cab 50. The angle of the boom 42 is further sensed by a boom angle sensor 52. This boom angle is also transmitted to the crane warning system illustrated in FIG. 4.

The object of the crane warning system is to alert the operator to hazardous overweight conditions. The relationship between the angle of the boom 42 shown in FIG. 2 and the maximum weight capacity is non-linear. It is necessary for the operator to read from a table, previously calculated, the maximum load capacity and compare this capacity to the actual load transmitted by the tension load cell 48 shown in FIG. 2. Although there are prior art electronic devices in existence, they have specific disadvantages in oil well application due to explosive conditions; and the operator is still required to preset the maximum capacity for a given boom angle.

Figure 3:
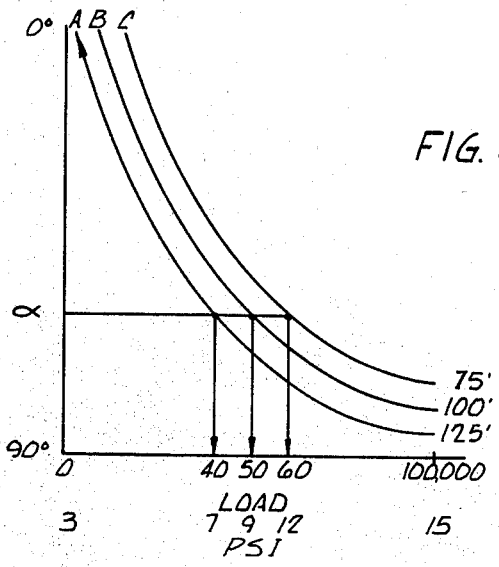
FIG. 3 is a graphical representation of the functional relationship of boom angle versus loading capacity; and, FIG. 4 is a partial schematic partial block diagrammatic view of a crane warning system in accordance with the present invention.

A further parameter that must be considered in the overall calculation of maximum load capacity is the length of the boom 42 utilized to lift any given load 46. As shown in the curve FIG. 3, angle is represented on the ordinant axis and is scaled 0°–90° while the maximum load is on the abscissa and scaled 0–100,000 lbs. There are three non-linear curves illustrated A, B and C representative of 125, 100, and 75, foot boom lengths. As shown in FIG. 3 for any angle alpha ($\alpha$) the load capacity of the crane decreases with increased boom length. Therefore, in a varying system where the boom lengths will change on a regular basis this parameter must be considered in the overall calculation of maximum capacity.

Figure 4:
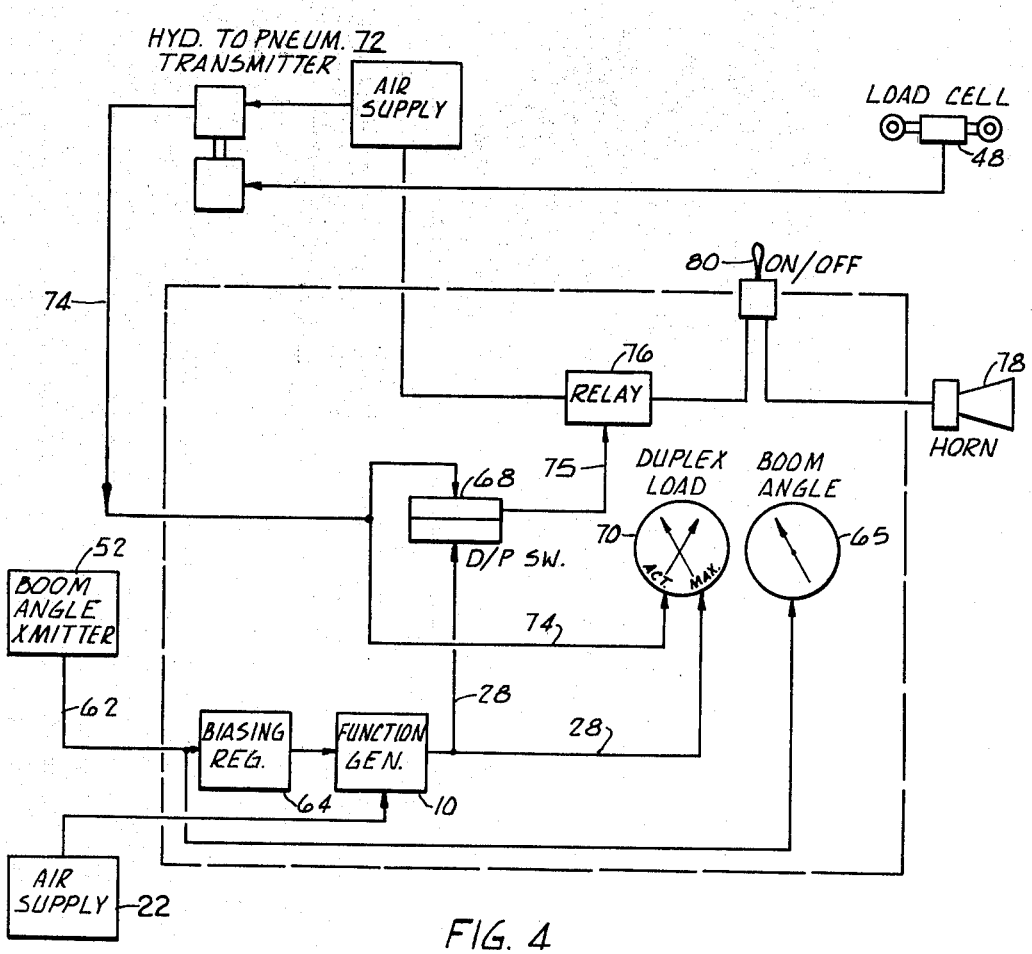

FIG. 4 demonstrates a specific embodiment of a crane warning system 60 utilizing the pneumatic function generator 10 described above. This crane warning system 60 includes a boom angle sensor 52 that may be located as shown in FIG. 2. This sensor delivers a pneumatic boom angle signal 62 varying with the changing of the boom angle by the operator. The pneumatic boom angle signal 62 is fed into a biasing regulator 64. The main function of the biasing regulator 64 is to adjust the boom angle signal 62 based upon the boom length parameter. If the boom length decreases a positive bias will be placed on the biasing regulator 64 that would be indicative of a boom angle capable of supporting a greater load. Conversely, there is a negative bias placed on the biasing regulator 64 when the boom length increases to effect a boom angle signal that would be indicative of a lower capacity. The boom angle signal 62 transmitted through the biasing regulator 64 is delivered to a pneumatic function generator 10 as described and illustrated for FIG. 1. The output signal 28 of the pneumatic function generator 10 is delivered to a differential pressure switch 68. The output signal 28 of the function generator 10 is also delivered to a duplex load gauge 70. Specifically with regard to the function generator 10, when the air signal in 11 is a boom angle signal and the rolling cam 16 is machined with a non-linear curve for a particular crane similar to those illustrated in FIG. 3, the output 28 will be representative of the maximum load capacity of the crane.

Thus the duplex load gauge 70 will have as one reading the maximum load capacity and as the other actual load, at the particular boom angle. The boom angle signal 62 is also delivered to a pneumatic boom angle gauge 65 for operator convenience.

The crane warning system 60 is further provided with a means for determining the actual weight of the load 46 shown in FIG. 2. As stated before this means may be in the form of a tension load cell 48. This tension load cell may be a hydraulic load cell, for example, model T-10 Pennant manufactured by Geosource. The hydraulic load cell signal is sent to an hydraulic to pneumatic transducer 72. The hydraulic/pneumatic transducer 72 will have as its output a pneumatic signal 74 indicative of the actual load weight. This pneumatic signal 74 is delivered to the differential pressure switch 68 to be compared with the maximum load capacity signal 28. The pneumatic weight signal 74 is also delivered to the duplex load gauge 70. Using the separate indicators the operator will be able to observe when the actual weight is approaching the maximum capacity at that boom angle.

The differential pressure switch 68 will emit a signal 75 when the maximum capacity signal 28 is exceeded by the actual weight signal 74. This signal will trigger the relay 76 allowing a supply of air to be delivered to a pneumatic horn 78 for purposes of warning the operator of the hazardous weight condition. On-off switch 80 may then be utilized by the operator to deactivate the pneumatic horn 78.

Operationally, as the operator changes the boom angle and boom length to pick up a load the crane warning system will automatically generate a boom angle signal. This signal will then be used to compute the maximum load capacity from the function generator 10 in the form of a pneumatic signal 28 which will be delivered to a differential pressure switch 68. The comparison to the actual weight received from the signal generated by the tension load cell 48 and the hydraulic to pneumatic transducer 72 will then be performed and if the actual weight is greater than the maximum capacity weight a pneumatic relay 76 is tripped and the pneumatic horn 78 is activated. Since the system is entirely pneumatic it may be easily adapted to an oil well environment.

In alternate embodiments the tension load cell 48 may be pneumatic in nature and not require the use of an hydraulic to pneumatic transducer. Further, where there is a constant boom length there would be no need for a biasing regulator 64.

While the present invention has been described in relation to specific embodiments, it should be apparent to those skilled in the art that various modifications may be made without departing from the spirit and scope of the invention.

What is claimed is:

1. A pneumatic warning system for a boom-type load lifting device comprising:

a pneumatic function generator including:

an air cylinder with means for receiving and storing an input pneumatic signal;

means for mechanically representing a predetermined curve, functionally dependent on said input pneumatic signal, mechanically connected to said air cylinder; and means for translating the function of said curve to an output pneumatic signal for any value of said input pneumatic signal, mechanically connected to and operatively associated with said means for representing said curve;

means for transmitting a boom angle pneumatic signal, pneumatically connected to said pneumatic function generator;

means for determining the weight of a load on said lifting device;

means for delivering a pneumatic load signal to said pneumatic function generator, comparator signal means for comparing said output signal of said pneumatic function generator with said pneumatic load signal, whereby said comparator means delivers a pneumatic output warning signal when said load signal exceeds said pneumatic function generator output signal; and warning signal means connected to said comparator signal means for sounding a warning when said load signal exceeds said pneumatic function generator output signal.

2. A pneumatic warning system as set forth in claim 1 wherein said means for transmitting a boom angle pneumatic signal comprises a pneumatic transmitter capable of delivering a predetermined pneumatic signal at a given boom angle.

3. A pneumatic warning system as set forth in claim 1 wherein said means for determining the weight of said load on said lifting device comprises a load cell.

4. A pneumatic warning system as set forth in claim 3 wherein said load cell is hydraulic.

5. A pneumatic warning system as set forth in claim 3 wherein said load cell is pneumatic.

6. A pneumatic warning system as set forth in claim 4 wherein said means for delivering a pneumatic load signal is a hydraulic to pneumatic transducer having a means for receiving a referenced air supply and said hydraulic load signal from said hydraulic load cell, and delivering a pneumatic signal indicative of the weight of said load.

7. A pneumatic warning system as set forth in claim 1 wherein said comparator signal means is a differential pressure switch.

8. A pneumatic warning system as set forth in claim 1 further including a pneumatic relay for boosting said warning signal.

9. A pneumatic warning system as set forth in claim 1 wherein said warning signal means comprises a pneumatic horn.

10. A pneumatic warning system as set forth in claim 1 further including a biasing air regulator pneumatically connected to said means for transmitting a boom angle pneumatic signal, for changing said boom angle signal with varying boom length.

11. A pneumatic warning system as set forth in claim 1 further including first and second pneumatic gauges for indicating the maximum capacity and actual load, and boom angle respectively.

12. A pneumatic warning system as set forth in claim 1 further including a pneumatic switch for deactivating said warning signal means.

* * * * *